US008727738B2

(12) United States Patent
Bass et al.

(10) Patent No.: US 8,727,738 B2
(45) Date of Patent: May 20, 2014

(54) JET PUMP ASSEMBLY HAVING INCREASED ENTRAINMENT FLOW

(75) Inventors: John Robert Bass, Leland, NC (US); Phillip G. Ellison, Wilmington, NC (US); Bobby Malone, Castle Hayne, NC (US); Jin Yan, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 560 days.

(21) Appl. No.: 12/546,956

(22) Filed: Aug. 25, 2009

(65) Prior Publication Data

US 2011/0052424 A1 Mar. 3, 2011

(51) Int. Cl.
*F04F 5/46* (2006.01)
*F04F 5/00* (2006.01)

(52) U.S. Cl.
USPC ..... 417/177; 417/151

(58) Field of Classification Search
USPC ..... 417/151, 177, 179
See application file for complete search history.

(56) References Cited

U.S. PATENT DOCUMENTS 1,506,908 A * 9/1924 Kirgan ..... 417/177
4,487,553 A * 12/1984 Nagata ..... 417/171
4,847,043 A * 7/1989 Gluntz ..... 376/372
6,450,775 B1 * 9/2002 Hutchinson et al. ..... 417/198
8,345,814 B2 1/2013 Ishida et al.

FOREIGN PATENT DOCUMENTS

JP 71199 U 7/1991
JP 2009-162638 7/2009

OTHER PUBLICATIONS

Mexican Office Action dated Jul. 11, 2013, issued in corresponding Mexican Application No. MX/a/2010/009374.
Unofficial English translation of a JP Office Action issued in connection with corresponding JP Patent Application No. 2010-185696 dated Dec. 2, 2013.

* cited by examiner

*Primary Examiner* — Charles Freay
*Assistant Examiner* — Philip Stimpert
(74) *Attorney, Agent, or Firm* — Harness, Dickey & Pierce, P.L.C.

(57) ABSTRACT

A jet pump assembly according to an example embodiment of the present invention includes an inlet body arranged in proximity with a throat structure so as to provide an entrainment entrance between a discharge end of the inlet body and the throat structure. A drive flow of a motive fluid is supplied at a first velocity to the inlet body and is discharged through at least one nozzle at a higher second velocity, thereby creating a pressure drop in the throat structure. The pressure drop facilitates a first entrained flow of suction fluid into the entrainment entrance and a second entrained flow of suction fluid through at least one channel passing through the inlet body. The at least one channel is configured such that the second entrained flow is isolated from the drive flow while passing through the inlet body.

16 Claims, 7 Drawing Sheets

JET PUMP ASSEMBLY HAVING INCREASED ENTRAINMENT FLOW

BACKGROUND

1. Field

The present disclosure relates to jet pumps for nuclear reactors.

2. Description of Related Art

FIG. 1 is a cutaway view of a conventional jet pump in a reactor pressure vessel of a boiling water reactor. Referring to FIG. 1, a drive flow 102 of a motive fluid (coolant outside the reactor pressure vessel) enters the riser pipe 104 and flows upwardly to the inlet elbows 106. As the drive flow 102 is discharged downwards through the nozzles 108, an entrained flow 110 of suction fluid (coolant inside the reactor pressure vessel) is drawn into the throat 112 of the mixer 114 and is mixed with the drive flow 102. The mixed flow continues downwardly to the diffusers 116 where the kinetic energy of the mixed flow is converted to pressure.

SUMMARY

A jet pump assembly according to an example embodiment of the present invention includes an inlet body having a receiving end, an intermediate section, and a discharge end, the inlet body configured to receive a drive flow of a motive fluid at a first velocity through the receiving end and to facilitate movement of the motive fluid through the inter mediate section to the discharge end. The jet pump assembly additionally includes a throat structure arranged in proximity to the discharge end of the inlet body so as to provide an entrainment entrance between the discharge end and the throat structure. The throat structure is configured to receive the motive fluid from the inlet body and first and second entrained flows of suction fluid external to the inlet body. The jet pump assembly also includes at least one channel extending from a surface of the intermediate section to a surface of the discharge end of the inlet body. The channel defines an entrainment passage for the second entrained flow of the suction fluid such that the second entrained flow is isolated from the drive flow while passing through the inlet body. The jet pump assembly further includes at least one nozzle disposed on the discharge end of the inlet body and configured to discharge the motive fluid from the inlet body into the throat structure at a second velocity, the second velocity being higher than the first velocity so as to create a pressure drop within the throat structure. The pressure drop facilitates the first entrained flow of suction fluid into the entrainment entrance and the second entrained flow of suction fluid through the at least one channel.

A method of increasing fluid entrainment in a jet pump assembly according to an example embodiment of the present invention includes providing an inlet body having a receiving end, an intermediate section, a discharge end, at least one nozzle disposed on the discharge end, and at least one channel extending from a surface of the intermediate section to a surface of the discharge end of the inlet body. The method additionally includes arranging the inlet body in proximity with a throat structure so as to provide an entrainment entrance between the discharge end of the inlet body and the throat structure. The method also includes supplying a drive flow of a motive fluid at a first velocity to the receiving end and through the intermediate section to the discharge end of the inlet body. The method further includes discharging the motive fluid from the inlet body through the at least one nozzle at a second velocity, the second velocity being higher than the first velocity so as to create a pressure drop in the throat structure. The pressure drop facilitates a first entrained flow of suction fluid into the entrainment entrance and a second entrained flow of suction fluid through the at least one channel. The at least one channel is configured such that the second entrained flow is isolated from the drive flow while passing through the inlet body.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
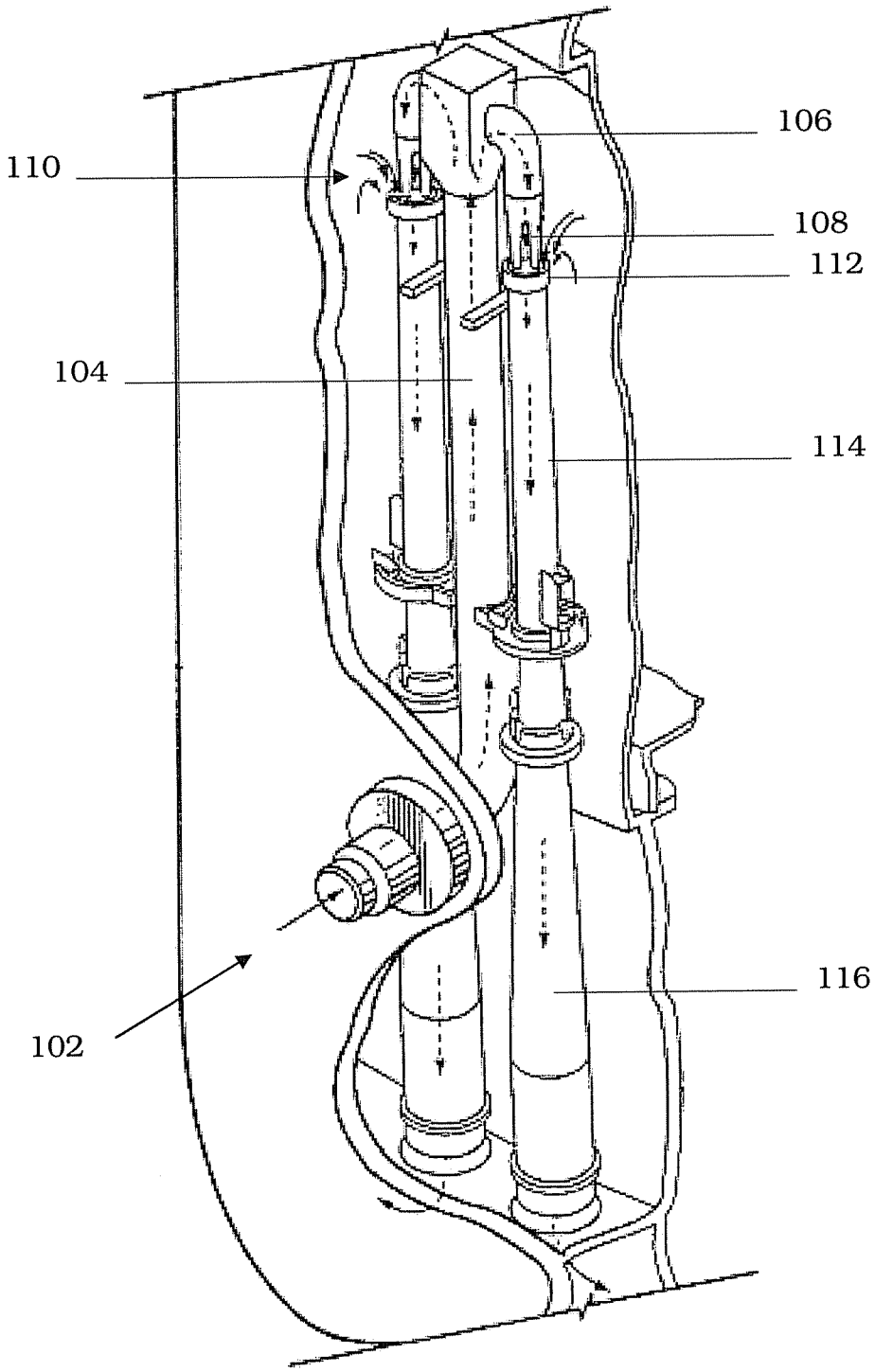
FIG. 1 CONVENTIONAL ART
FIG. 1 is a cutaway view of a conventional jet pump in a reactor pressure vessel of a boiling water reactor.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 2A:
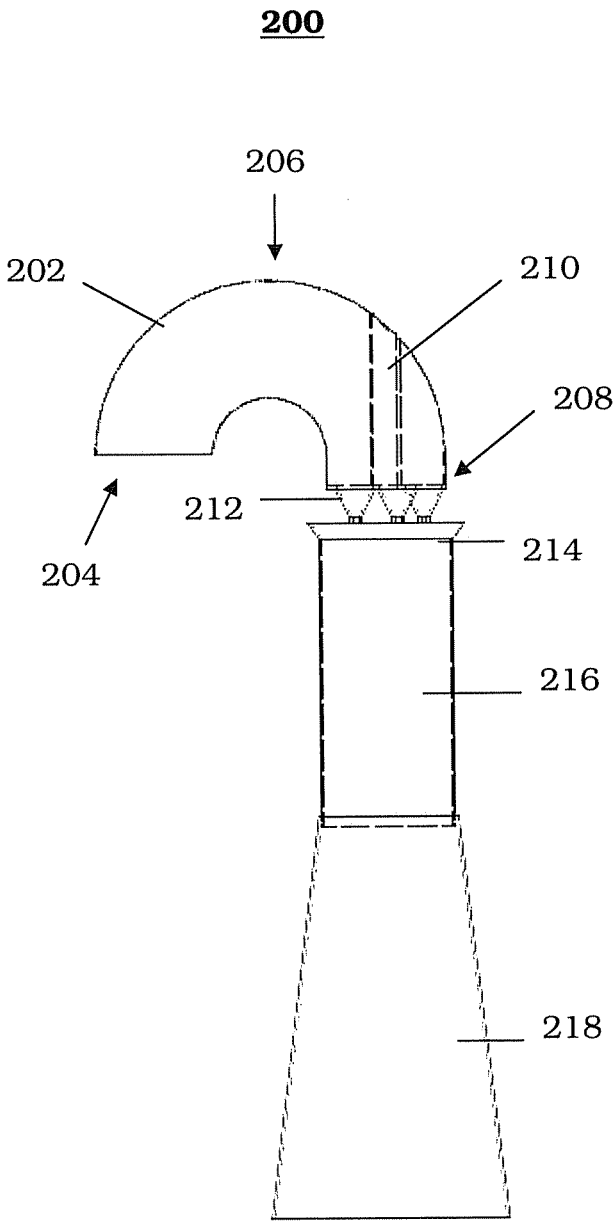
FIG. 2A is a first side view of a jet pump assembly according to an example embodiment of the present invention.
Figure 2B:
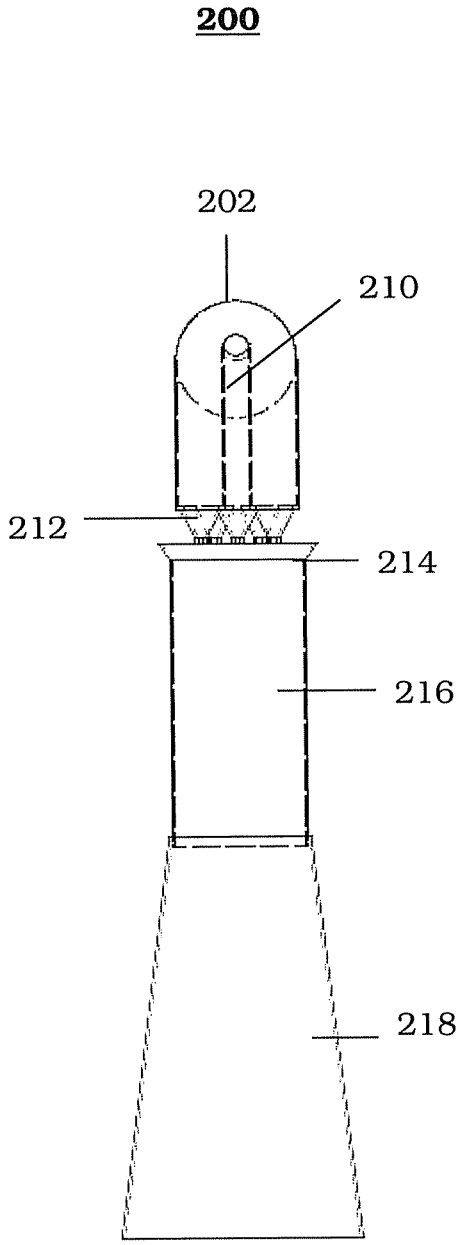
FIG. 2B is a second side view of a jet pump assembly according to an example embodiment of the present invention.
Figure 2C:
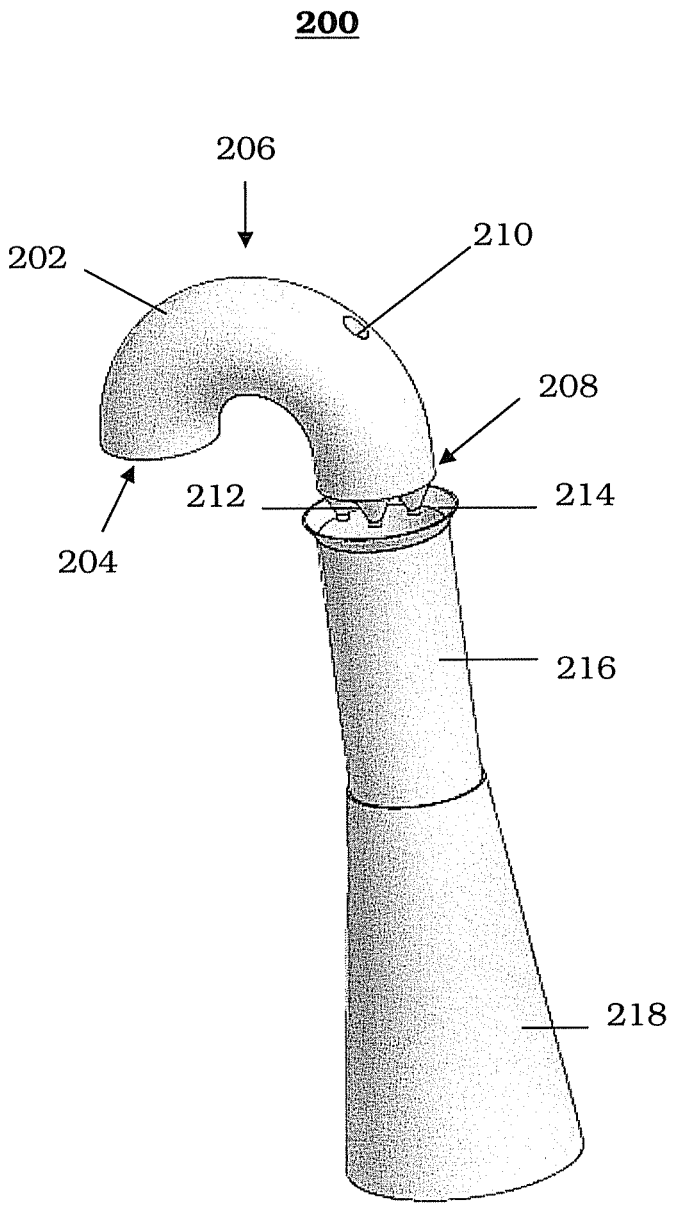
FIG. 2C is a perspective view of a jet pump assembly according to an example embodiment of the present invention.
Figure 3:
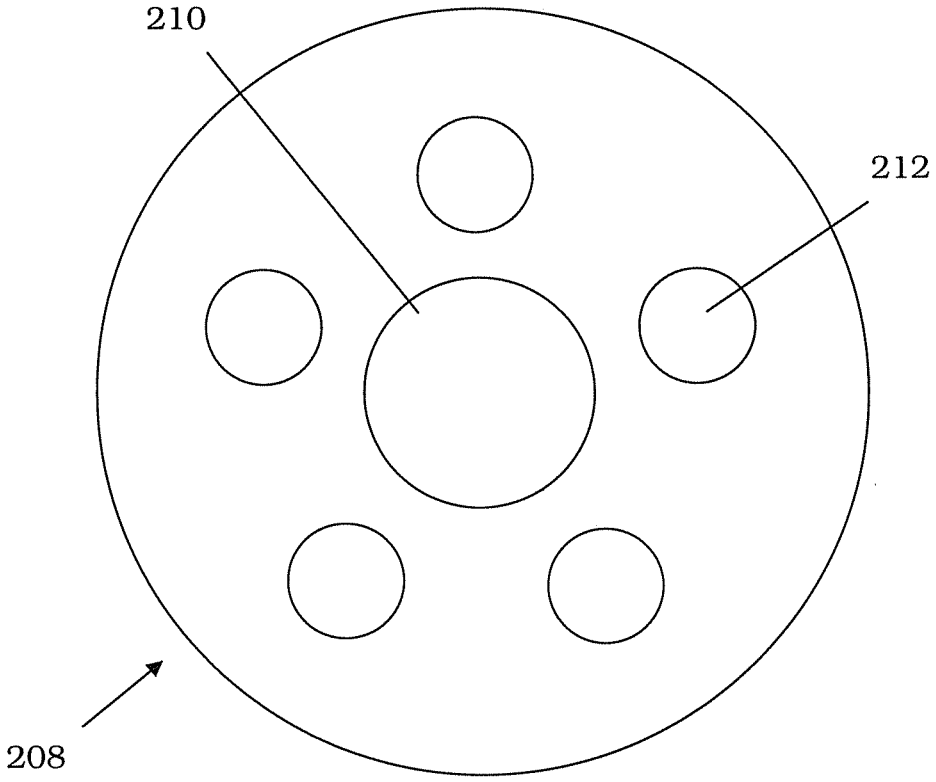
FIG. 3 is a bottom view of a discharge end of an inlet body according to an example embodiment of the present invention.
Figure 4:
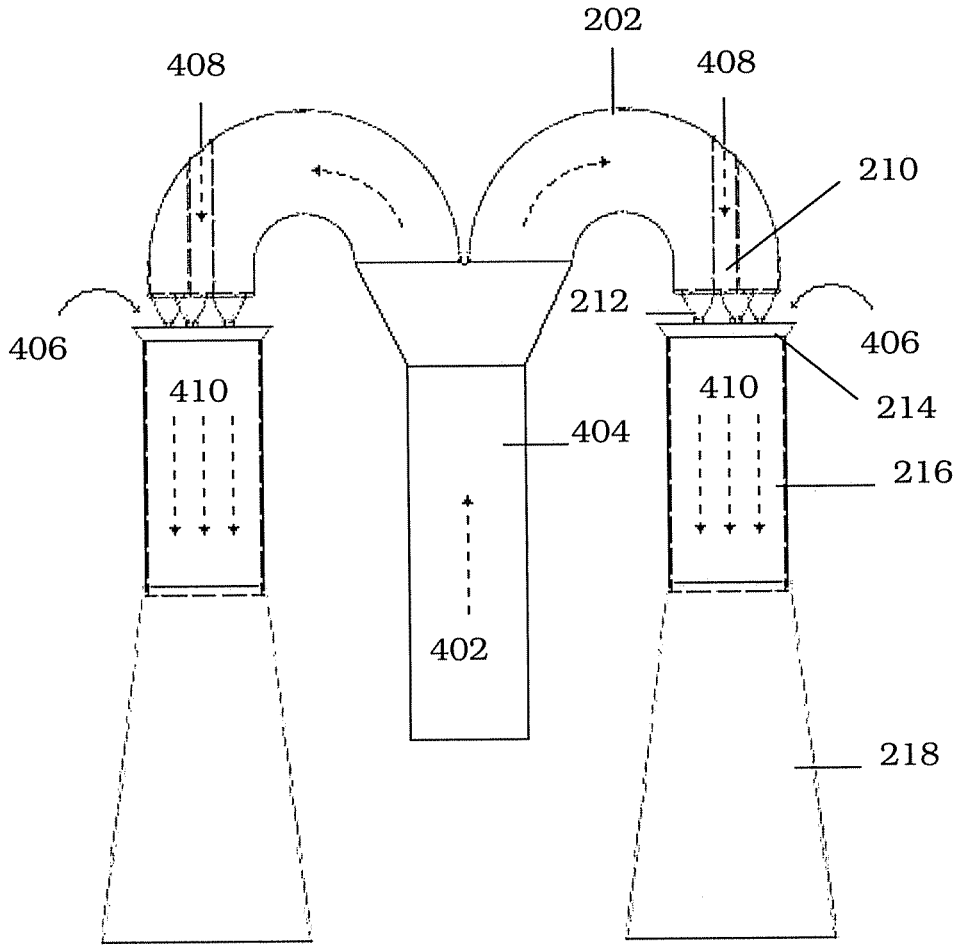
FIG. 4 is a depiction of the drive flow, first entrained flow, and second entrained flow during the operation of a jet pump assembly according to an example embodiment of the present invention.

FIG. 2A is a first side view of a jet pump assembly according to an example embodiment of the present invention. FIG. 2B is a second side view of a jet pump assembly according to an example embodiment of the present invention. FIG. 2C is a perspective view of a jet pump assembly according to an example embodiment of the present invention. FIG. 3 is a bottom view of a discharge end of an inlet body according to an example embodiment of the present invention. FIG. 4 is a depiction of the drive flow, first entrained flow, and second entrained flow during the operation of a jet pump assembly according to an example embodiment of the present invention.

Referring to FIGS. 2A-4, the jet pump assembly 200 includes an inlet body 202 having a receiving end 204, an intermediate section 206, and a discharge end 208. The inlet body 202 is configured to receive a drive flow 402 of a motive fluid from a riser pipe 404. The drive flow 402 is received at a first velocity through the receiving end 204 of the inlet body 202 and moves through the intermediate section 206 to the discharge end 208. As illustrated in the figures, the inlet body 202 may be elbow-shaped, although other suitable shapes may also be used.

A throat structure 214 is arranged in proximity to the discharge end 208 of the inlet body 202 so as to provide an entrainment entrance between the discharge end 208 and the throat structure 214. For instance, the throat structure 214 may be arranged below the inlet body 202 so as to be aligned with the discharge end 208. The entrainment entrance accommodates a first entrained flow 406 of suction fluid into the throat structure 214.

The jet pump assembly 200 may optionally include a throat connector configured to facilitate a connection between the inlet body 202 and the throat structure 214. The throat connector may have an upper portion configured to support the discharge end 208 of the inlet body 202 so as to provide the entrainment entrance and a lower portion configured to rest on a rim of the throat structure 214. The throat connector may be a separate component or may be integrally for as part of the inlet body 202.

A channel 210 extends from a surface of the intermediate section 206 to a surface of the discharge end 208 of the inlet body 202. The channel 210 defines an entrainment passage for a second entrained flow 408 of the suction fluid. The passage defined by the channel 210 is distinct from the openings for the nozzles 212. As a result, the second entrained flow 408 is isolated from the drive flow 402 while passing through the inlet body 202. The channel 210 may be cylindrically-shaped, although other shapes may also be suitable. Additionally, although the channel 210 is shown as extending vertically, it should be understood that the channel 210 may also extend at an angle. Furthermore, although only one channel 210 per inlet body 202 is illustrated in the figures, it should be understood that a plurality of channels 210 may be provided for each inlet body 202 to increase the entrained flow area.

A plurality of nozzles 212 are disposed on the discharge end 208 of the inlet body 202 and configured to discharge the motive fluid from the inlet body 202 into the throat structure 214 at a second velocity. The second velocity of the discharged drive flow 402 is higher than the first velocity of the incoming drive flow 402, thereby creating a pressure drop within the throat structure 214. The pressure drop draws the first entrained flow 406 of suction fluid into the entrainment entrance and the second entrained flow 408 of suction fluid through the channel 210. Although a plurality of nozzles 212 are illustrated in the figures, it should be understood that one nozzle or a plurality of nozzles (e.g., five) may be used depending on the circumstances.

Referring to FIG. 3, the channel 210 extends to a surface of the discharge end 208 surrounded by the plurality of nozzles 212. It should be understood that when a plurality of channels are employed, the channels may be arranged amongst the plurality of nozzles in a manner that would facilitate an increase in entrained flow.

The throat structure 214 is configured to receive the drive flow 402 of motive fluid discharged from the nozzles 212, the first entrained flow 406 of suction fluid drawn through the entrainment entrance, and the second entrained flow 408 of suction fluid drawn through the channel 210. The discharged drive flow 402, first entrained flow 406, and second entrained flow 408 form a mixed flow 410 in the mixer 216 of the jet pump assembly 200. The mixed flow 410 continues to the diffuser 218 where the kinetic energy of the mixed flow 410 is converted to pressure. As a result of the channel 210, the core flow in the reactor may be increased, thereby improving efficiency.

Figure 5:
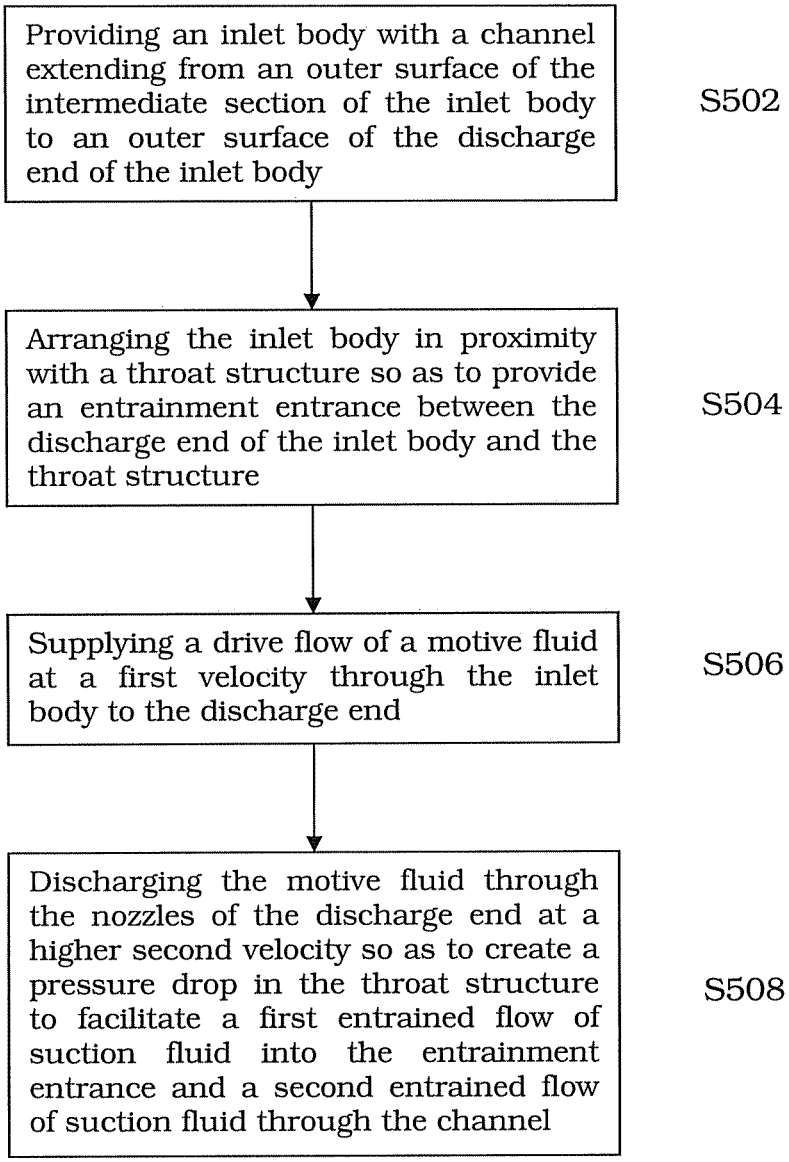
FIG. 5 is a flow diagram of a method of increasing fluid entrainment in a jet pump assembly according to an example embodiment of the present invention.

FIG. 5 is a flow diagram of a method of increasing fluid entrainment in a jet pump assembly according to an example embodiment of the present invention. Referring to step S502 of FIG. 5, the method includes providing an inlet body 202 with a channel 210 extending from an outer surface of the inter section 206 of the inlet body 202 to an outer surface of the discharge end 208 of the inlet body 202.

Referring to step S504 of FIG. 5, the method additionally includes arranging the inlet body 202 in proximity with a throat structure 214 so as to provide an entrainment entrance between the discharge end 208 of the inlet body 202 and the throat structure 214. The throat structure 214 may be arranged below the inlet body 202 so as to be aligned with the discharge end 208.

Referring to step S506 of FIG. 5, the method also includes supplying a drive flow 402 of a motive fluid at a first velocity to the receiving end 204 of the inlet body 202 such that the drive flow 402 travels through the intermediate section 206 to the discharge end 208 of the inlet body 202. The drive flow 402 may travel along a curved path through the inlet body 202.

Referring to step S208 of FIG. 2, the method further includes discharging the motive fluid from the inlet body 202 through least one nozzle 212 at a second velocity. The second velocity of the discharged drive flow 402 is higher than the first velocity of the incoming drive flow 402, thereby creating a pressure drop in the throat structure 214. As a result of the pressure drop, a first entrained flow 406 of suction fluid is drawn into the entrainment entrance and a second entrained flow 408 of suction fluid is drawn into the channel 210. The passage defined by the channel 210 is distinct from the openings of the nozzles 212. As a result, the second entrained flow 408 is isolated from the drive flow 402 while passing through the inlet body 202.

The second entrained flow 408 may enter the inlet body 202 through an upper surface of the intermediate section 206 of the inlet body 202. The second entrained flow 408 may also travel a straight path through the inlet body 202. In addition to being straight, the path may also be vertical. The second entrained flow 408 may exit the inlet body 202 through a center of the discharge end 208. However, it should be understood that other variations are also possible. For instance, the path of the second entrained flow 408 through the inlet body 202 may be curved.

One or more nozzles 212 may be disposed at the discharge end 208 of the inlet body 202. When a plurality of nozzles 212 are employed, the channel 210 may be arranged such that the second entrained flow 408 exits the inlet body 202 at a surface of the discharge end 208 surrounded by the plurality of nozzles 212. For instance, the drive flow 402 may be discharged from the inlet body 202 through five nozzles 212, and the second entrained flow 408 may exit the inlet body 202 at a surface of the discharge end 208 surrounded by the five nozzles 212.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A jet pump assembly comprising:

an inlet body having a receiving end, an intermediate section, and a discharge end, the inlet body configured to receive a drive flow of a motive fluid at a first velocity through the receiving end and to facilitate movement of the motive fluid through the intermediate section to the discharge end;

a throat structure arranged in proximity to the discharge end of the inlet body so as to provide an entrainment entrance between the discharge end and the throat structure, the throat structure configured to receive the motive fluid from the inlet body and first and second entrained flows of suction fluid external to the inlet body;

at least one channel extending from a curved upper surface of the intermediate section to a bottom surface of the discharge end of the inlet body, the at least one channel defining an entrainment passage for the second entrained flow of the suction fluid such that the second entrained flow is isolated from the drive flow while passing through the inlet body;

at least one nozzle disposed on the discharge end of the inlet body and configured to discharge the motive fluid from the inlet body into the throat structure at a second velocity, the second velocity being higher than the first velocity so as to create a pressure drop within the throat structure, the pressure drop facilitating the first entrained flow of suction fluid into the entrainment entrance and the second entrained flow of suction fluid through the at least one channel.

2. The jet pump assembly of claim 1, wherein the inlet body is elbow-shaped.

3. The jet pump assembly of claim 1, wherein the throat structure is arranged below the inlet body so as to be aligned with the discharge end.

4. The jet pump assembly of claim 1, wherein the at least one channel is aligned with a center of the throat structure.

5. The jet pump assembly of claim 1, wherein the at least one nozzle includes a plurality of nozzles disposed on the discharge end of the inlet body.

6. The jet pump assembly of claim 5, wherein the plurality of nozzles includes five nozzles disposed on the discharge end of the inlet body.

7. The jet pump assembly of claim 5, wherein the at least one channel includes a single channel extending to a center of the surface of the discharge end.

8. The jet pump assembly of claim 5, wherein the at least one channel extends to the surface of the discharge end surrounded by the plurality of nozzles.

9. The jet pump assembly of claim 1, wherein the at least one channel is cylindrically-shaped.

10. The jet pump assembly of claim 1, wherein the at least one channel extends vertically from the surface of the intermediate section to the surface of the discharge end of the inlet body.

11. The jet pump assembly of claim 1, wherein a diameter of the at least one channel is greater than a diameter of the at least one nozzle.

12. The jet pump assembly of claim 1, wherein an inner diameter of the receiving end of the inlet body is greater than an inner diameter of the at least one channel.

13. The jet pump assembly of claim 1, wherein a total volume of the inlet body is greater than a total volume of the at least one channel.

14. The jet pump assembly of claim 1, wherein the at least one nozzle extends beyond the at least one channel in a direction coinciding with the movement of the motive fluid from the discharge end.

15. The jet pump assembly of claim 1, wherein the at least one channel extends through an elbow portion of the inlet body.

16. The jet pump assembly of claim 1, wherein the inlet body defines a first isolated space of a first volume for the drive flow, and the at least one channel defines a second isolated space of a second volume for the second entrained flow, the first volume being greater than the second volume.

* * * * *